US012553622B2

(12) United States Patent
Baldwin, Jr. et al.

(10) Patent No.: US 12,553,622 B2
(45) Date of Patent: Feb. 17, 2026

(54) ASSEMBLIES FOR SUPPORTING AIR CONDITIONING UNITS

(71) Applicant: Midea Group Co., Ltd., Foshan (CN)

(72) Inventors: Donald William Baldwin, Jr., Louisville, KY (US); Joel M. Gray, Prospect, KY (US)

(73) Assignee: Midea Group Co., Ltd., Foshan (CN)

( * ) Notice: Subject to any disclaimer, the term of this patent is extended or adjusted under 35 U.S.C. 154(b) by 68 days.

(21) Appl. No.: 18/394,495

(22) Filed: Dec. 22, 2023

(65) Prior Publication Data

US 2025/0207789 A1 Jun. 26, 2025

(51) Int. Cl.
*F24F 1/031* (2019.01)

(52) U.S. Cl.
CPC ..... *F24F 1/031* (2019.02)

(58) Field of Classification Search
CPC ..... F24F 1/031
See application file for complete search history.

(56) References Cited

U.S. PATENT DOCUMENTS

| | | | | |
|---|---|---|---|---|
| 5,636,816 | A * | 6/1997 | Burton | F24F 13/32 62/262 |
| 8,533,955 | B2 * | 9/2013 | Agnihotri | F16M 13/02 248/209 |
| 8,584,998 | B1 | 11/2013 | Peterson | |
| 9,163,854 | B2 | 10/2015 | Arbucci | |
| 9,303,895 | B1 * | 4/2016 | Grant | F24F 13/32 |
| 9,447,916 | B2 * | 9/2016 | Darby | F24F 13/32 |
| 9,982,909 | B1 | 5/2018 | Perez et al. | |
| 10,295,221 | B2 | 5/2019 | Zhang | |
| 10,859,288 | B1 | 12/2020 | Carnegie | |
| 11,168,920 | B1 * | 11/2021 | Leezer | F24F 1/027 |
| 11,339,993 | B2 * | 5/2022 | Zhao | F24F 13/32 |
| 11,397,023 | B2 * | 7/2022 | Xing | F24F 1/62 |
| 11,397,024 | B2 * | 7/2022 | Xing | F24F 1/0003 |
| 11,566,815 | B2 * | 1/2023 | Martinez Galvan | F24F 13/32 |
| 11,739,979 | B2 * | 8/2023 | Leezer | F24F 13/32 248/208 |
| 12,013,144 | B2 * | 6/2024 | Yu | F24F 1/031 |

(Continued)

FOREIGN PATENT DOCUMENTS

| | | |
|---|---|---|
| CN | 218033690 U | 12/2022 |
| CN | 219572255 U | 8/2023 |

OTHER PUBLICATIONS

IVATION; Air Conditioner Window Support Bracket; url: https://www.ivationproducts.com/collections/air-conditioners/products/ivaacmount-ac-mounting-bracket; Oct. 20, 2023.

*Primary Examiner* — Monica E Millner
(74) *Attorney, Agent, or Firm* — Dinsmore & Shohl LLP

(57) ABSTRACT

An air conditioner support assembly includes an upper arm having a body having a top face and a bottom face, and a pair of sidewalls extending from the body. A slot is formed in the body and a plurality of notches are formed the pair of sidewalls. A lower arm has a main surface and a pair of side surfaces. A carrier bracket is shaped and sized to fit within the upper arm bottom face and the pair of sidewalls of the upper arm, the carrier bracket coupled to the lower arm via a coupling pin. A shoulder bolt extends through the slot of the upper arm and an opening of the carrier bracket. A spring element is disposed within the slot of the upper arm and coupled to the carrier bracket.

20 Claims, 8 Drawing Sheets

(56) References Cited

U.S. PATENT DOCUMENTS

| | | | | |
|---|---|---|---|---|
| 2012/0137499 | A1* | 6/2012 | Agnihotri | F16M 13/02 248/670 |
| 2013/0153744 | A1 | 6/2013 | Jin et al. | |
| 2018/0023842 | A1* | 1/2018 | Gardikis, Sr. | F16M 13/02 248/674 |
| 2021/0180828 | A1 | 6/2021 | Xing et al. | |
| 2021/0325054 | A1* | 10/2021 | Zhao | F24F 13/32 |
| 2021/0341175 | A1* | 11/2021 | Leezer | F24F 13/32 |
| 2022/0381475 | A1* | 12/2022 | Lei | F24F 13/32 |
| 2023/0213215 | A1* | 7/2023 | DeRossett | F24F 13/32 62/262 |
| 2025/0043990 | A1* | 2/2025 | Surwillo | F24F 1/031 |

* cited by examiner

ASSEMBLIES FOR SUPPORTING AIR CONDITIONING UNITS

BACKGROUND

The present embodiments relate to assemblies for supporting air conditioning units, with particular embodiments shown for adjustable length air condition support assemblies which can be used for window-mounted air conditioning units and adjusted without disassembly or using tools.

Air conditioning units, such as window-mounted air conditioning units, often times are supported with various brackets to keep the air conditioning unit securely held in place, such as to a window frame or side of a building. In order to allow for the brackets to be suitable for various locations and sizes, the brackets may be adjustable, such as adjustable length. Typical air conditioning support brackets may be complex and require a user to use tools and/or disassemble the brackets in order to adjust the brackets to fit the user's location. A need therefore exists in the art for an air conditioner support assembly which can be adjusted simply and without requiring tools or disassembly.

SUMMARY

The herein-described embodiments address these and other problems associated with the art by providing assemblies for supporting an air conditioning unit which can be adjusted simply and without requiring tools or disassembly. In various embodiments, the assembly may include at least two support pieces which may be moveable relative to one another, as well as mechanisms for fixing the support pieces at a desired length.

In various embodiments, an air conditioner support assembly includes an upper arm having a body having a top face and a bottom face, and a pair of sidewalls extending from the body. A slot is formed in the body and a plurality of notches are formed in each of the pair of sidewalls. A lower arm has a main surface and a pair of side surfaces, each of the pair of side surfaces having a first through hole at a first end of the lower. A carrier bracket is shaped and sized to fit within the upper arm bottom face and the pair of sidewalls of the upper arm, the carrier bracket having an upper face and a pair of side faces, each of the pair of side faces having a carrier bracket through hole and the carrier bracket coupled to the lower arm via a coupling pin. A shoulder bolt extends through the slot of the upper arm and an opening of the carrier bracket. A spring element is disposed within the slot of the upper arm and coupled to the carrier bracket, wherein the spring element is configured to bias the carrier bracket towards the upper arm, and the carrier bracket is configured to rotate about the shoulder bolt.

In addition, in some embodiments an air conditioner support assembly, the assembly includes a first channel having a first end and a second end, a first wall, a second wall, and a third wall, the first wall and third wall parallel to one another and each of the first wall and third wall perpendicular to the second wall. The second wall has a cutout at the second end, and a locking pin is disposed above the cutout of the second wall between the first wall and the third wall. A second channel has a top wall, a first side wall, and a second side wall, the second channel having a plurality of slots formed in the first wall, second wall, and third wall. The plurality of slots are shaped and sized to accommodate the locking pin. The second channel is shaped and sized to fit within the first channel. The second channel is rotatable within the cutout of the second wall such that, when rotated, the top wall of the second channel may pass beneath the locking pin while the second channel is displaced relative to the first channel.

In further embodiments, an air conditioner support assembly includes an inner member having a pair of slots placed on opposite sides of one another. Each of the pair of slots have an upper portion and a lower portion. The lower portion has a plurality of saw tooth shaped tabs. An outer member is shaped and sized to fit around the inner member. The outer member has a pair of two-portion slots, each of the pair of two-portion slots having a vertical portion and an angled portion. The inner member is shaped and sized to fit within the outer member. A locking pin is shaped and sized to fit within the pair of the two-portion slots of the outer member and the pair of slots of the inner member.

These and other advantages and features are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used in any way to the scope of the claimed subject matter.

DETAILED DESCRIPTION

Figure 1:
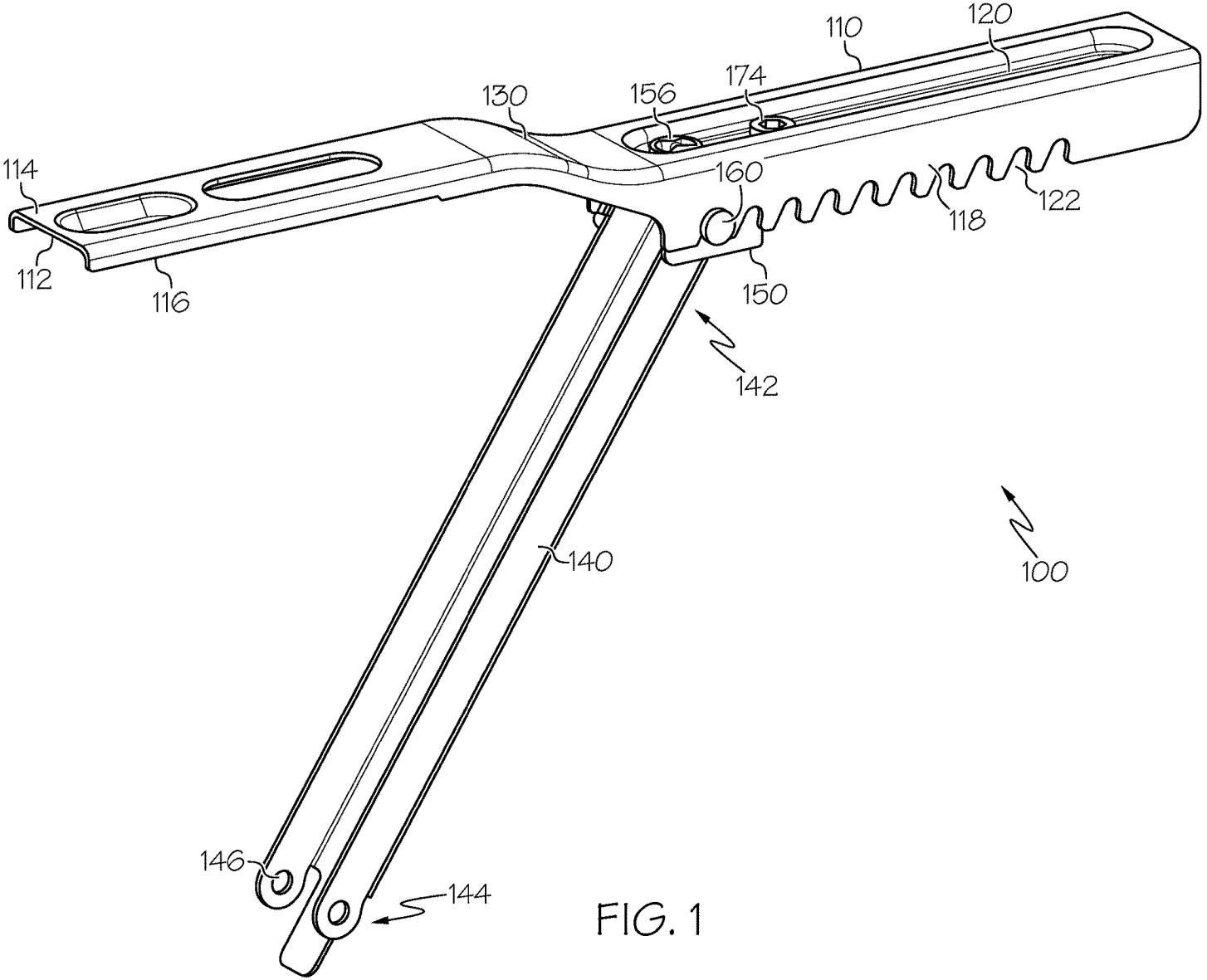
FIG. 1 is a perspective view of an upper arm and a lower arm of an embodiment of an air conditioner support assembly.
Figure 2:
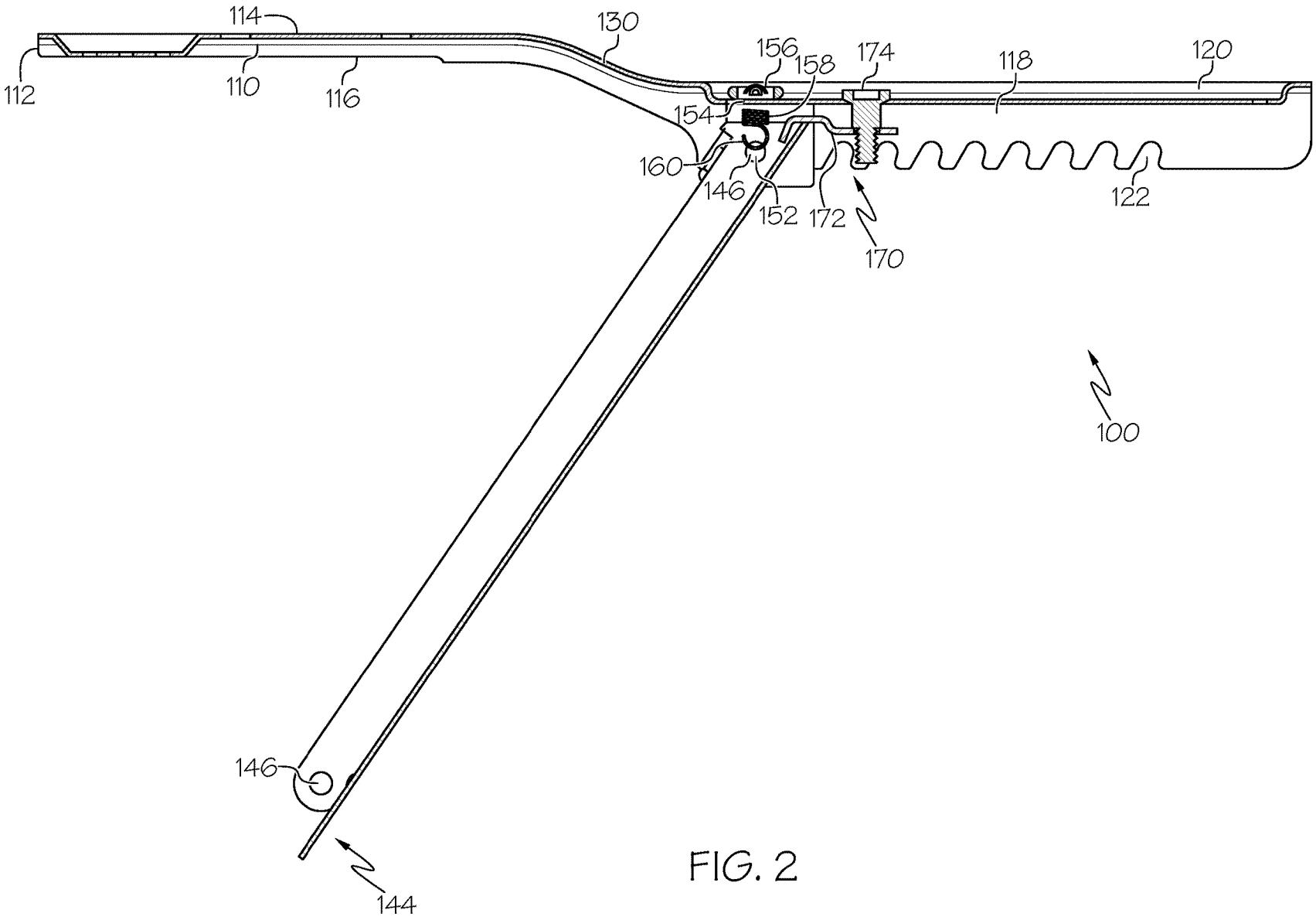
FIG. 2 is a section view of an upper arm and a lower arm of an embodiment of an air conditioner support assembly.

Turning now to the drawings, wherein like numbers denote like parts throughout the several views, FIG. 1 and FIG. 2 illustrates and air conditioning support assembly 100. The air conditioning support assembly 100 includes an upper arm 110 and a lower arm 140. The upper arm 110 includes a body 112 having a top face 114 and a bottom face 116, and a pair of sidewalls 118 extending from the body 112. A slot 120 is formed in the body 112. A plurality of notches 122 are formed in the pair of sidewalls 118.

As illustrated, the upper arm 110 has an offset 130 in order to contour to the underside of an air conditioning unit. However, it should be understood that the upper arm 110 may have any suitable profile, including but not limited to a straight profile.

The lower arm 140 has a first end 142 and a second end 144. The first end 142 and the second end 144 have a plurality of mounting holes 146. The plurality of mounting holes 146 at the second end 144 may be used to mount the lower arm 140 to a support surface such as a wall or a windowsill, to allow the air conditioning support assembly 100 to have a support point for supporting an air conditioner unit. As illustrated, the second end 144 has a plurality of mounting holes 146, but it should be understood that in embodiments, the second end 144 may have any other suitable mounting method, such as studs, teeth, or any other suitable mounting method.

A carrier bracket 150 is coupled to the first end 142 via a coupling pin 160, which may engage the first end 142 through mounting holes 146. The carrier bracket 150 may include a pair of side holes 152 and a top hole 154. The carrier bracket 150 may be coupled to the upper arm 110 via the coupling pin 160, which engages the plurality of notches 122 formed in the pair of sidewalls 118. A spring bolt 156 is placed through the slot 120 and through the top hole 154. The spring bolt 156 is coupled to a spring 158. The spring 158 may be any suitable type of spring, including but not limited to a torsion spring, a coil spring, a leaf spring, or any other suitable type of spring. The spring 158 is coupled to the coupling pin 160. The spring 158 allows for the coupling pin 160 and carrier bracket 150 to move relative to the upper arm 110.

A shoulder bolt 174 is placed through the slot 120. The shoulder bolt 174 is coupled to the carrier bracket 150 via arm 172. The shoulder bolt 174 may be moved vertically upward away from the upper arm 110, which causes the carrier bracket 150 to rotate and the coupling pin 160 to move vertically downward away from the plurality of notches 122. This allows for the coupling pin 160 to be slideable relative to the upper arm 110. The lower arm 140 may then be displaced relative to the upper arm 110. The shoulder bolt 174 may then be reset, allowing the coupling pin 160 to engage with the plurality of notches 122. This allows a user to adjust the total length of the air conditioning support assembly 100 without the use of tools or without requiring disassembly of the air conditioning support assembly 100.

The upper arm 110 and the lower arm 140 may be constructed of any suitable material, including but not limited to metals such as steel or aluminum, plastic, or any other suitable material for use in supporting an air conditioner unit.

Figure 3:
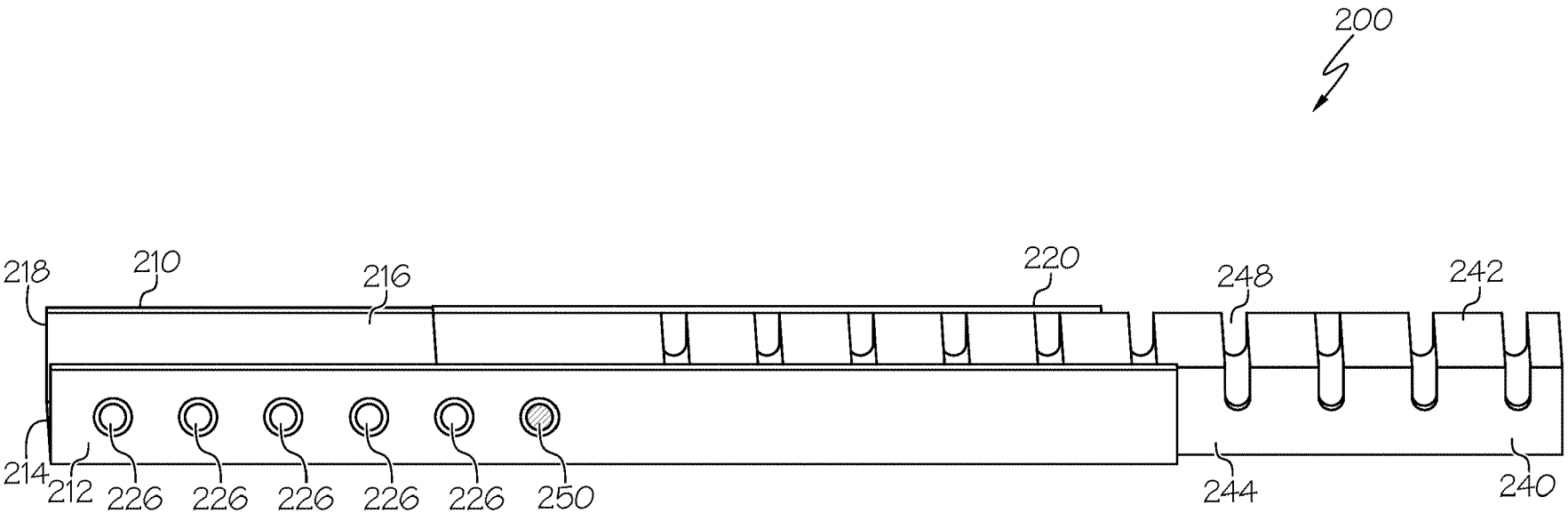
FIG. 3 is a side view of a first channel and a second channel nested within one another of an embodiment of an air conditioner support assembly.
Figure 4:
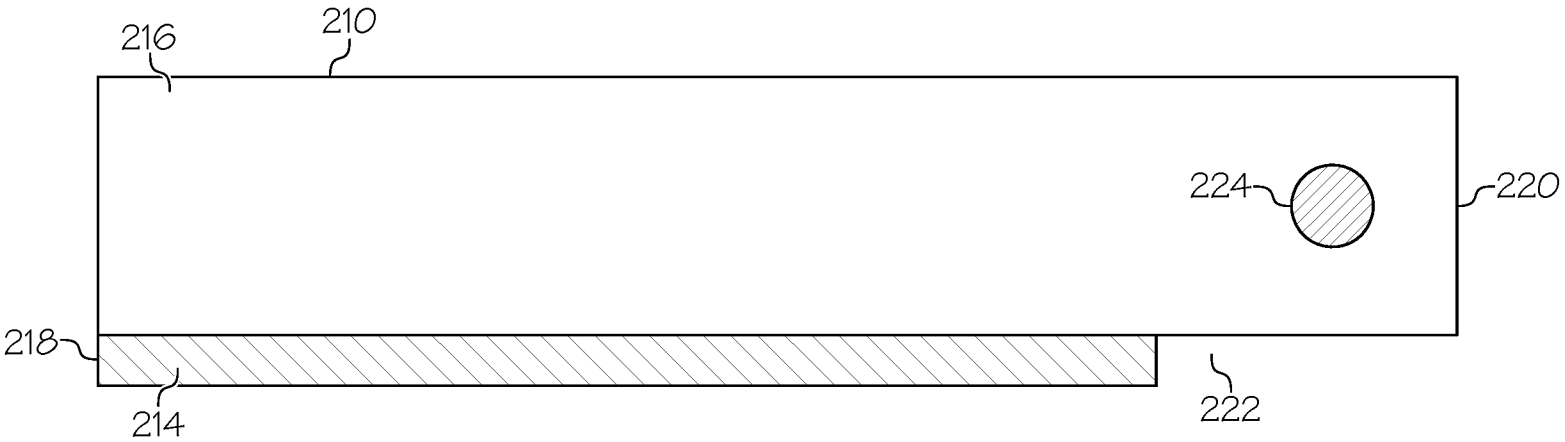
FIG. 4 is a section view of the first channel un-nested from the second channel of an embodiment of an air conditioner support assembly.
Figure 5:
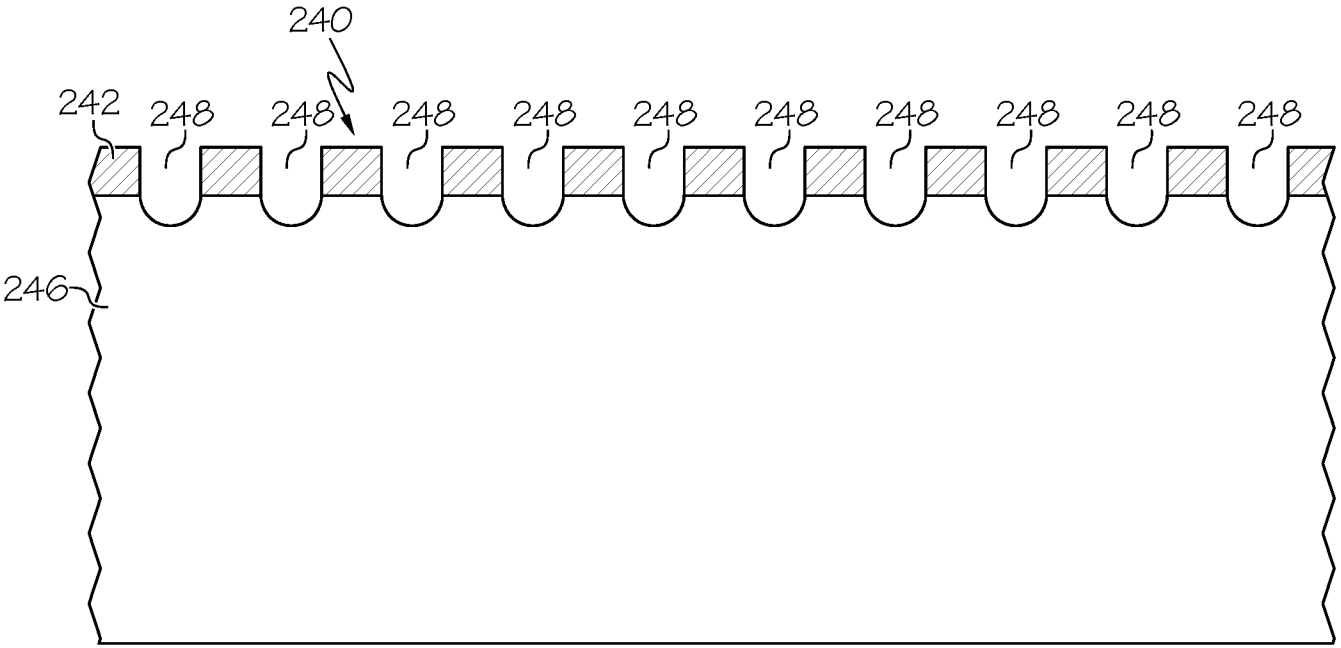
FIG. 5 is a section view of the second channel un-nested from the first channel of an embodiment of an air conditioner support assembly.

Referring now to FIG. 3, FIG. 4, and FIG. 5, an air conditioning support assembly 200 is illustrated. The air conditioning support assembly 200 includes a first channel 210 and a second channel 240. The second channel 240 may be nested inside of the first channel 210.

The first channel 210 includes a first wall 212, a second wall 214, and a third wall 216. The first wall 212 and the third wall 216 are parallel to one another, and both the first wall 212 and third wall 216 are perpendicular to the second wall 214, such that the first wall 212, the second wall 214, and the third wall 216 forms an approximate "C" shape which makes up the first channel 210. The first channel 210 has a first end 218 and a second end 220.

The second wall 214 has a cutout 222 formed at the second end 220, such that the first wall 212 and the third wall 216 extend further towards the second end 220 than the second wall 214. The cutout 222 may be a portion of material removed from the second wall 214. The cutout 222 may be shaped and sized so as to allow rotation of the second channel 240, as will be discussed in more detail below. In embodiments, the cutout 222 may have a rectangular shape, a semi-circular shape, or any other suitable shape.

A locking pin 224 is disposed between the first wall 212 and the third wall 216. The locking pin 224 may be shaped and sized to allow for the rotation of the second channel 240 relative to the first channel 210, as will be described in more detail below. The locking pin 224 may be coupled to the first wall 212 and the third wall 216 through any suitable coupling means, including but not limited to welding, adhesives, or mechanical fasteners. In some embodiments, the locking pin 224 may be constructed from the same piece of material as the first wall 212 and the third wall 216.

The third wall 216 may have one or more pin holes 226. While six pin holes 226 are illustrated, it should be understood that there may be any suitable number of pin holes 226, such as one pin holes 226, two pin holes 226, five pin holes 226, or any other suitable number of pin holes 226. It should further be understood that, while the one or more pin holes 226 are illustrated in the third wall 216, the one or more pin holes 226 may be in the first wall 212, or on both the third wall 216 and the first wall 212.

The second channel 240 includes a top wall 242, a first side wall 244, and a second side wall 246. The second channel 240 is shaped and sized to fit within the first channel 210.

The second channel 240 includes one or more slots 248 formed in the top wall 242, the first side wall 244, and the second side wall 246. The one or more slots 248 may be shaped and sized to allow the locking pin 224 to be disposed therein. As illustrated, the one or more slots 248 have a semicircular edge, but it should be understood that in embodiments, the one or more slots 248 may have a square edge, or any other suitably shaped edge.

The second channel 240 is rotatable relative to the first channel 210 such that the second channel 240 moves within the cutout 222 and below the locking pin 224. The second channel 240 may be displaced relative to the first channel 210 while the second channel 240 is within the cutout 222 and below the locking pin 224. The second channel 240 may be rotated so that the locking pin 224 is placed inside one of the one or more slots 248 when the air conditioning support assembly 200 is at a desired length. This allows a user to adjust the total length of the air conditioning support assembly 200 without the use of tools or without requiring disassembly of the air conditioning support assembly 200.

The second channel 240 may include a spring loaded button 250 disposed on and protruding from at least one of the first side wall 244 and the second side wall 246. The spring loaded button 250 may be inserted into one of the pin holes 226. By inserting the spring loaded button 250 inside of one of the pin holes 226, the first channel 210 and the second channel 240 may have a firmer connection relative to one another compared to an embodiment without a spring loaded button 250 and pin holes 226.

The first channel 210 and the second channel 240 may be constructed of any suitable material, including but not limited to metals such as steel or aluminum, plastic, or any other suitable material for use in supporting an air conditioner unit.

Figure 6:
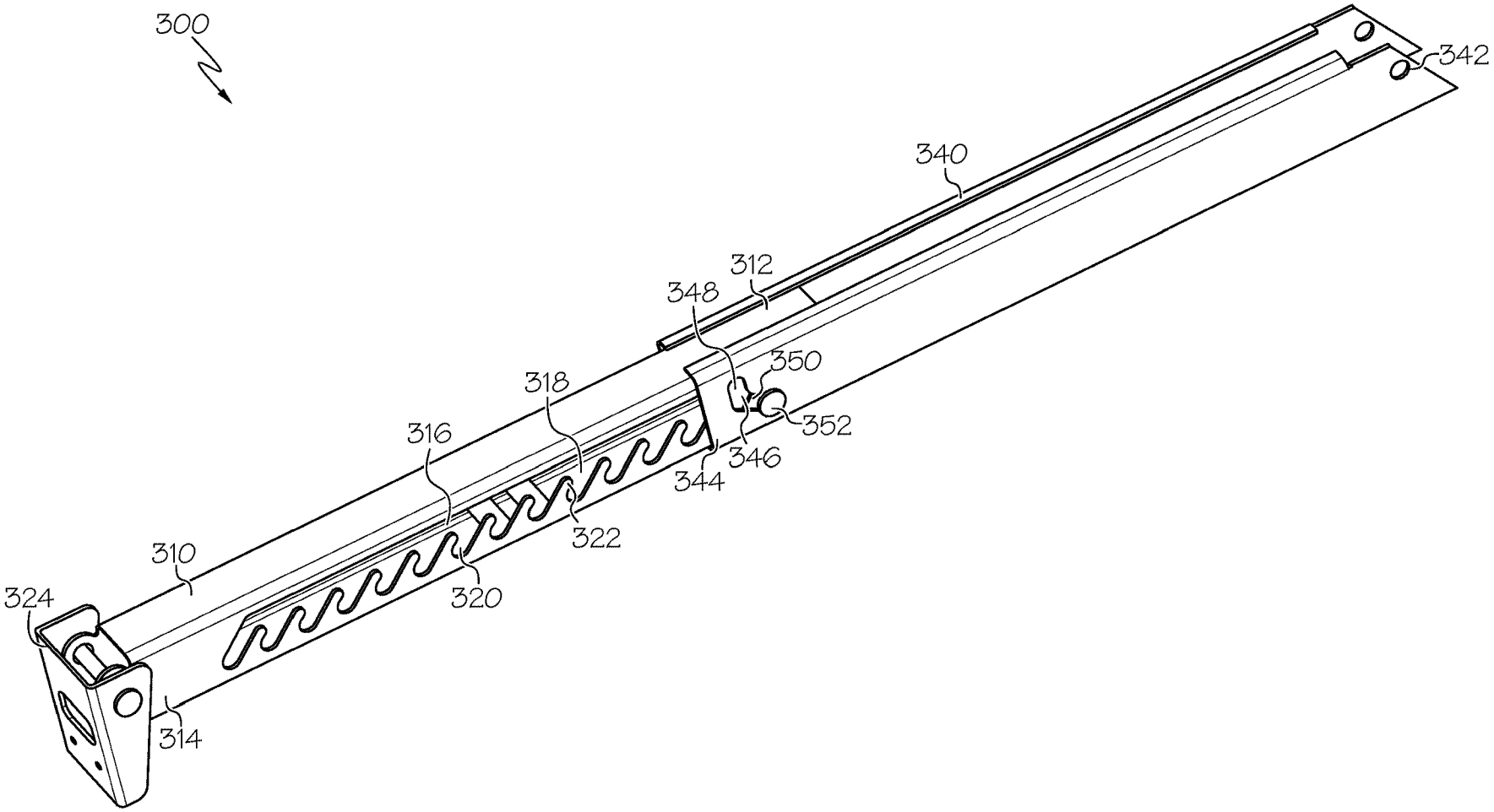
FIG. 6 is a perspective view of an inner member nested within an outer member of an embodiment of an air conditioner support assembly.
Figure 7:
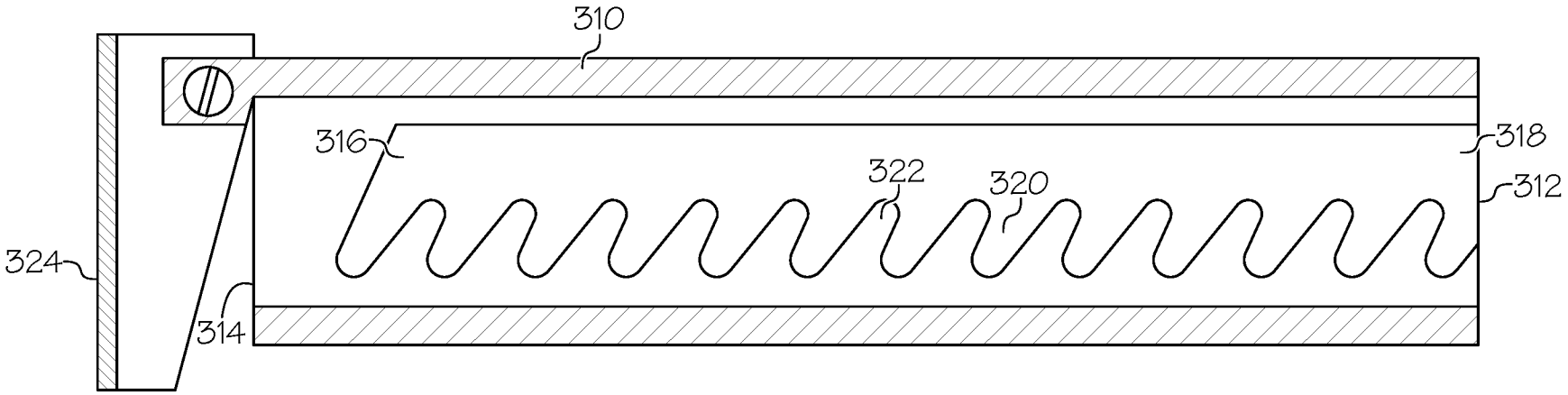
FIG. 7 is a section view of the inner member un-nested from the outer member of an embodiment of an air conditioner support assembly.
Figure 8:
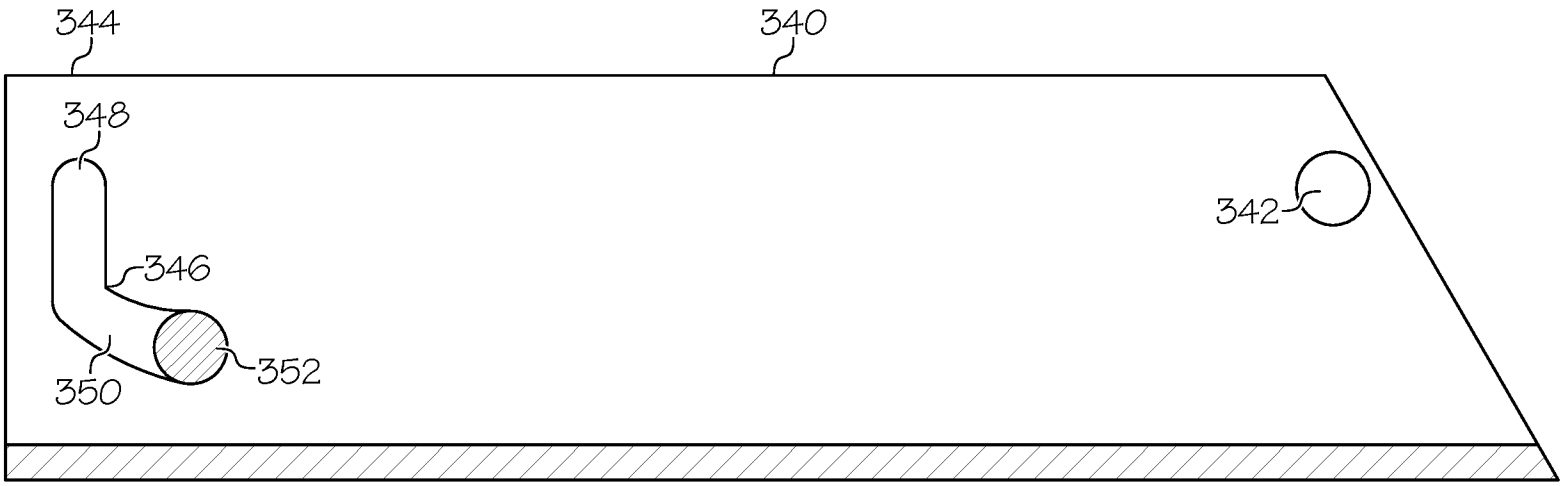
FIG. 8 is a section view of the outer member-un-nested from the inner member of an embodiment of an air conditioner support assembly.

Referring now to FIG. 6, FIG. 7, and FIG. 8, an air conditioning support assembly 300 is illustrated. The air conditioning support assembly 300 includes an inner member 310 and an outer member 340. The outer member 340 is shaped and sized to fit around the inner member 310.

The inner member 310 has a first end 312 and a second end 314. The inner member 310 has a pair of slots 316 each placed on opposite sides of the inner member 310. Each of the pair of slots 316 has an upper portion 318 and a lower portion 320. Each of the lower portions 320 has a plurality of saw tooth shaped tabs 322. The plurality of saw tooth shaped tabs 322 may be angled towards the second end 314. By angling the plurality of saw tooth shaped tabs 322, the plurality of saw tooth shaped tabs 322 may be used to retain the outer member 340, as will be discussed in more detail herein.

A bracket 324 may be placed at the second end 314. The bracket 324 may be coupled to the inner member 310 via a hinge to allow the bracket 324 to rotate relative to the inner member 310. The bracket 324 may be configured to support an air conditioning unit. As illustrated, the bracket 324 has a plurality of mounting holes, but it should be understood that in embodiments, the bracket 324 may have any other suitable mounting method, such as studs, teeth, or any other suitable mounting method.

The outer member 340 has a support end 342 and a connection end 344. The support end 342 may have a mechanism to attach to a support surface, such as a wall or a windowsill, to allow the air conditioning support assembly 300 to have a support point for supporting an air conditioner unit. As illustrated, the support end 342 has a plurality of through holes for supporting an air conditioner unit, but it should be understood that in embodiments, other types of mechanisms may be used, such as a bracket, one or more studs, or other suitable mechanism. In further embodiments, the support end 342 may be coupled to a horizontal member of a support bracket similar to upper arm 110 illustrated in FIG. 1.

The connection end 344 has a pair of two-portion slots 346. Each of the pair of two-portion slots 346 has a vertical portion 348 and an angled portion 350. A locking pin 352 is disposed between the pair of two-portion slots 346 and engages the pair of slots 316 and the pair of two-portion slots 346 so as to retain the inner member 310 to the outer member 340.

The inner member 310 is moveable relative to the outer member 340. As the inner member 310 is moved relative to the outer member 340 to extend the length of the air conditioning support assembly 300, locking pin 352 may move upward along one of the saw tooth shaped tabs 322 and into the subsequent saw tooth shaped tab 322. This may be repeated until the air conditioning support assembly 300 has reached a desired length. The inner member 310 may then be compressed relative to the outer member 340 to engage the locking pin 352 in the desired saw tooth shaped tab 322.

As the inner member 310 is moved relative to the outer member 340 to decrease the length of the air conditioning support assembly 300, the inner member 310 can be stretched relative to the outer member 340 so that the locking pin 352 may be moved upward into the upper portions 318 of the slots 316. The inner member 310 may then be moved relative to the outer member 340 to decrease the length of the air conditioning support assembly 300. When the air conditioning support assembly 300 has reached a desired length, the locking pin 352 may be moved back into the lower portions 320 of the slots 316.

The inner member 310 and the outer member 340 may be constructed of any suitable material, including but not limited to metals such as steel or aluminum, plastic, or any other suitable material for use in supporting an air conditioner unit.

Numerous variations and modifications to the air conditioning support assemblies 100, 200, and 300 illustrated in FIGS. 1-8 will be apparent to one of ordinary skill in the art, as apparent from the description above. Therefore, the invention is not limited to the specific implementations discussed herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An air conditioner support assembly, the assembly comprising:

an upper arm having a body having a top face and a bottom face, and a pair of sidewalls extending from the body, wherein a slot is formed in the body and a plurality of notches are formed in each of the pair of sidewalls;

a lower arm having a main surface and a pair of side surfaces, each of the pair of side surfaces having a mounting hole at a first end of the lower arm;

a carrier bracket shaped and sized to fit within the bottom face and the pair of sidewalls of the upper arm, the carrier bracket having an upper face and a pair of side faces, the upper face having a top hole, each of the pair of side faces having a side hole, and the carrier bracket coupled to the lower arm via a coupling pin extending through each of the side holes;

a spring bolt extending through the slot of the upper arm and the top hole of the carrier bracket; and a spring coupled to the spring bolt and coupled to the coupling pin, wherein the spring is configured to allow the carrier bracket to move relative to the upper arm.

2. The air conditioner support assembly of claim 1, wherein the carrier bracket is slidable along the upper arm.

3. The air conditioner support assembly of claim 1, wherein the coupling pin is configured to engage the plurality of notches.

4. The air conditioner support assembly of claim 1, wherein the upper arm further comprises an offset along the top face.

5. The air conditioner support assembly of claim 1, wherein the upper arm further comprises a bracket configured to attach to an air conditioning unit.

6. The air conditioner support assembly of claim 1, wherein the lower arm further comprises a bracket configured to attach to a support surface.

7. The air conditioner support assembly of claim 1, wherein the spring further comprises a coil spring.

8. The air conditioner support assembly of claim 1, further comprising a shoulder bolt extending from the bottom face of the upper arm.

9. The air conditioner support assembly of claim 8, wherein the shoulder bolt is configured to move vertically upward away from the upper arm, causing the carrier bracket to rotate and the coupling pin to move vertically downward away from the bottom face of the upper arm.

10. The air conditioner support assembly of claim 9, further comprising an arm coupled to the shoulder bolt and coupled to the carrier bracket, wherein the arm is configured to push the carrier bracket away from the bottom face of the upper arm, causing the coupling pin to move away from the plurality of notches.

11. An air conditioner support assembly, the assembly comprising:

an upper arm having a body having a top face and a bottom face, and a pair of sidewalls extending from the body, wherein a plurality of notches are formed in each of the pair of sidewalls;

a lower arm having a first end and a second end and main surface and a pair of side surfaces, each of the pair of side surfaces having a mounting hole at the first end of the lower arm;

a spring bolt extending from the bottom face of the upper arm;

a shoulder bolt extending from the bottom face of the upper arm, the shoulder bolt configured to move vertically upward away from the upper arm;

a carrier bracket having a pair of side faces, each of the pair of side faces having a side hole;

a coupling pin engaged to the lower arm through the mounting hole and engaged to the carrier bracket through the side holes, the coupling pin configured to be engaged with the upper arm at a selected one or more of the plurality of notches;

a spring coupled to the spring bolt and coupled to the coupling pin, the spring configured to selectively retain the coupling pin within one of the plurality of notches; and an arm coupled to the shoulder bolt and coupled to the first end of the lower arm, the arm configured to push the lower arm away from the one of the plurality of notches via the vertically upward movement of the shoulder bolt.

12. The air conditioner support assembly of claim 11, wherein the upper arm further comprises an offset along the top face.

13. The air conditioner support assembly of claim 11, wherein the upper arm further comprises a bracket configured to attach to an air conditioning unit.

14. The air conditioner support assembly of claim 11, wherein the lower arm further comprises a bracket configured to attach to a support surface.

15. The air conditioner support assembly of claim 11, wherein the spring further comprises a coil spring.

16. An air conditioner support assembly, the assembly comprising:

an upper arm having a first end, a second end, and a body, wherein said body further comprises an offset therein between the first end and the second end, and wherein the body further comprises a top face and a bottom face and a pair of sidewalls extending from the body, wherein a slot is formed in the body through the top face and the bottom face, and wherein a plurality of opposing notches is formed in each of the pair of sidewalls;

a lower arm having a first end and a second end and a main surface and a pair of side surfaces, each of the pair of side surfaces having a mounting hole at a first end of the lower arm;

a carrier bracket shaped and sized to fit within the bottom face and the pair of sidewalls of the upper arm, the carrier bracket having an upper face and a pair of side faces, the upper face having a top hole, each of the pair of side faces having a side hole, and the carrier bracket coupled to the lower arm via a coupling pin extending through each of the side holes;

a spring bolt extending through the slot of the upper arm and the top hole of the carrier bracket;

a spring coupled to the spring bolt and coupled to the coupling pin, wherein the spring is configured to allow the carrier bracket to selectively move within the pair of sidewalls of the upper arm at varying distances from the second end of the upper arm; and a shoulder extending from the bottom face and through the slot of the upper arm, the shoulder bolt mechanically coupled to the carrier bracket via an arm.

17. The air conditioner support assembly of claim 16, wherein the coupling pin is configured to be insertable into selective one or more of the plurality of notches.

18. The air conditioner support assembly of claim 16, wherein the spring is configured to retain the coupling pin within one of the plurality of notches.

19. The air conditioner support assembly of claim 16, wherein the shoulder bolt is operable to selectively move vertically upward with the slot.

20. The air conditioner support assembly of claim 19, wherein upward movement of the shoulder bolt causes rotation of the carrier bracket away from the bottom face of the upper arm, thereby freeing the coupling pin from one of the plurality of notches to thereby facilitate sliding movement of the carrier bracket along the upper arm.

* * * * *